US005459891A

United States Patent [19]

Reeve et al.

[11] Patent Number: 5,459,891

[45] Date of Patent: Oct. 24, 1995

[54] INVALID LIFT AND TRANSPORT APPARATUS

[76] Inventors: Richard J. Reeve; Fredrick A. Roper, both of 1133 Koontz La., Carson City, Nev. 89701-6502

[21] Appl. No.: 111,118

[22] Filed: Aug. 24, 1993

[51] Int. Cl.[6] ..... A61G 7/10

[52] U.S. Cl. ..... 5/87.1; 5/831; 212/231; 212/247

[58] Field of Search ..... 212/230, 231, 212/247, 248, 254; 414/921; 5/81.1, 83.1, 85.1, 87.1

[56] References Cited

U.S. PATENT DOCUMENTS

| | | | |
|---|---|---|---|
| 502,725 | 6/1896 | Hepburn | 5/87.1 |
| 841,702 | 1/1907 | Martin | 212/254 X |
| 2,793,768 | 5/1957 | Schaedler | 5/83.1 X |
| 2,846,091 | 8/1958 | Heffner | 5/87.1 X |
| 3,207,044 | 9/1965 | Hall | 212/231 X |
| 3,301,416 | 1/1967 | Bopp | 212/231 X |
| 3,477,595 | 11/1969 | Whitfield | 212/231 X |
| 3,659,594 | 5/1972 | Schwab . | |
| 3,677,424 | 7/1972 | Anderson . | |
| 3,738,500 | 6/1973 | Coleman et al. | 212/248 |
| 3,877,421 | 9/1973 | Brown . | |
| 4,117,561 | 10/1978 | Zamotin . | |
| 4,125,908 | 11/1978 | Vail et al. . | |
| 4,202,064 | 5/1980 | Joergensen | 5/83.1 |
| 4,554,691 | 11/1985 | Daugherty | 5/81.1 |
| 4,571,758 | 2/1986 | Samuelsson . | |
| 4,944,056 | 7/1990 | Schroeder et al. | 5/81.1 |
| 5,001,789 | 3/1991 | Schoenberger . | |
| 5,077,844 | 1/1992 | Twitchell et al. . | |

FOREIGN PATENT DOCUMENTS

| | | | |
|---|---|---|---|
| 3707005 | 9/1988 | Germany | 5/83.1 |

OTHER PUBLICATIONS

"Product Comparison & Evaluation—Patient Lifts", Jan. 1990, 102 pgs. by: Anita Perr, Pub: Rehab. Engineering ctr at the Nat. Rehab. Hospital.

Pamphlet–"Guardian Homecare Patient Lifts" 1989, 2 pgs, Guardian Products, Inc., Arleta, Calif. 91331–4522.

Pamphlet "Portable Patient Lifts" 1991, 4 pgs, Invacare Corp. Elyria, Ohio 44036.

"Century's Model C3 Multifunctional Sling Lift/Transfer System" 2 page Sales Brochure.

*Primary Examiner*—Michael F. Trettel

*Attorney, Agent, or Firm*—Richard C. Litman

[57] ABSTRACT

An invalid lift and transport apparatus for safely lifting and transporting bedridden or wheelchair bound individuals with a minimum of effort and assistance is disclosed. The apparatus includes a movable mast assembly powered by a remote hydraulic pump. The mast assembly has an upright mast rotatable about a substantially vertical axis and a hydraulically extensible boom, for supporting an invalid carrying sling, pivotally joined thereto. A lift cylinder, joining the lower portion of the mast with the boom, is provided for raising and lowering the boom. A hand-held controller permits the invalid individual or attendant to extend, retract, raise, and lower the boom by selectively actuating the hydraulic components with the touch of a button. The mast may be similarly rotated. In operation, the sling may be readily moved to position an invalid seated therein to practically any position within the reach of the boom with a minimum of physical effort.

17 Claims, 8 Drawing Sheets

INVALID LIFT AND TRANSPORT APPARATUS

FIELD OF THE INVENTION

The present invention relates generally to invalid beds and surgical supports. More specifically, the present invention pertains to an apparatus for safely lifting and transporting bedridden or wheelchair bound individuals with a minimum of effort and assistance.

BACKGROUND OF THE INVENTION

Unfortunately, many people have become so disabled by the ravages of disease or injury that they are unable to stand or walk without assistance. Movements from a bed or a chair to bathing or toilet facilities are often highly problematic. Without a minimum level of muscular strength, the aid and support of one or more attendants is often required for even the smallest changes in position. Frequently, a disabled individual must be lifted and carried from one place to another, a task which can demand more dexterity and strength than those caring for such an individual in the home may have. Often, the burden of transporting an individual who is paralyzed, or is otherwise severely afflicted, is so difficult that costly professional help or nursing home care is required.

DESCRIPTION OF THE RELATED ART

In view of the difficulties associated with manually transferring a disabled individual from one position to another, certain devices have been developed for mechanically aiding in the lifting and transporting of such individuals. Well known vehicles used for this purpose include wheelchairs and stretchers. One problem encountered with these particular devices, however, is that they provide no means for readily loading a disabled passenger upon their carrying surfaces. Unloading a disabled passenger may be equally difficult.

A variety lifters have been developed to hoist and transport disabled individuals. Such lifters vary from stationary models mounted upon automobiles as well as bath tubs, to mobile models capable of being wheeled from one location to another. While many conventional lifters are capable of being moved about, they generally provide no means for repositioning or moving the disabled individual without moving the entire device, a difficult process in confined areas. Moreover, movement of the device for effecting small movements of the individual may cause unnecessary jostling and perhaps even physical harm in some cases.

Another well known problem associated with the construction of prior art lifters is that they are generally relatively fragile and, because of their narrow bases, are somewhat unstable and subject to tipping over during use. Larger lifts, on the other hand, while having greater strength and stability, are undesirable to the extent that they are difficult to move and maneuver in confined areas. Further, the relatively heavy structural elements employed in the larger lifts require strong supporting surfaces for their safe operation which are generally not found in the construction of private dwelling houses.

U.S. Pat. No. 3,659,594, issued May 2, 1972 to Raymond Schwab, shows the construction of an apparatus for manipulating the vertebral column of human patients. This apparatus includes a manually extensible hydraulic jack for outwardly extending a cantilevered arm from a wheeled frame. The distal end of the arm is equipped with knee supporting saddles from which a patient may be extended head downward.

U.S. Pat. No. 3,877,421, issued Apr. 15, 1975 to Cicero C. Brown, provides a patient lift and exercise apparatus having a number of mechanical features, each of which may be actuated by turning a separate hand crank. For instance, the base may be widened by separating two opposed rails through the manual rotation of an elongated, threaded shaft engaging extendable cross members which join the rails together. Similarly, the height of a boom assembly and the lateral positioning of a patient carrying sling may be adjusted by the rotation of threaded shafts with hand cranks. It must be noted that an attendant is required to manipulate the hand cranks during use of the apparatus as such are beyond the reach of a patient seated within the sling.

U.S. Pat. No. 4,117,561, issued Oct. 3, 1978 to Rodvinon I. Zamotin, discloses a patient lift device having a rotatable drum, onto which a flexible cable is wound, in movable engagement with a cantilever boom assembly. The drum may be moved horizontally along the boom, and cable dispensed therefrom, by the rotation of nested hand wheels by an attendant. The attendant also serves as a counterbalance of the moment exerted by the patient suspended upon the boom. Neither the height nor the length of the cantilever boom assembly are variable.

U.S. Pat. No. 4,571,758, issued Feb. 25, 1986 to Frank A. Samuelsson, describes an apparatus for vertically lifting and radially moving a person over a supporting surface having a cantilevered boom with a movable truck joined thereto from which a person may be suspended in a sling. A person with sufficient strength in both arms may release the truck's brake by depressing an overhead lever and then, with the free hand, grasp the top of the boom to push himself to a desired radial position. A "central lead screw" positioned within the two-piece supporting column and having a 12 to 18 inch (30 to 45 centimeter) stroke is provided for vertically moving the boom. Further, a geared motor mounted atop the column is provided for rotating the boom about a vertical axis. Actuation of the central lead screw and geared motor is provided through a series of switches positioned upon a control box in electrical communication with the remainder of the apparatus.

U.S. Pat. No. 5,001,789, issued Mar. 26, 1991 to Luther V. Schoenberger, teaches the construction of an invalid lift and transport apparatus having a body support assembly pivotally mounted upon a wheeled frame. The body support assembly is seen to include subassemblies for engaging the shoulders, trunk, and knees of an invalid. In use, the body support assembly may be rotated in a vertically oriented plane through the actuation of two jacking units from a first position in which the invalid is in a generally seated orientation to a second, elevated position where the invalid is oriented in a generally prone position.

U.S. Pat. No. 5,077,844, issued Jan. 7, 1992 to Kendel S. Twitchell, suggests the construction of an apparatus for lifting and moving humans which is capable of motor assisted motion about horizontal and vertical axes. A boom, pivotally mounted upon a vertical mast, rotates with the mast as such is turned by a geared motor. An extendible strut, joining the base of the mast and the distal end of the boom, raises and lowers the boom when actuated by a second motor. Two eyelets affixed to the distal end of the boom provide for the selective positioning of a sling for supporting an invalid.

None of the above inventions and patents, taken either singly or in combination, is seen to describe the instant invention as claimed. Clearly, there remains a need for an invalid lift and transport apparatus that is mechanically movable and powered in its lifting, extending and rotating functions, and that has controls operable by the invalid alone so that he can cause himself to be moved about without the assistance of another person.

SUMMARY OF THE INVENTION

The present invention provides a combination invalid lift and transport apparatus which can be used in a home, health care facility, or other location to lift, position, and transport an invalid or bed-ridden individual from one location to another. The apparatus of the present invention comprises a movable mast assembly supported between fixed mounting brackets and powered by a remote hydraulic pump. The mast assembly includes an upright mast rotatable about a substantially vertical axis. An extensible boom for supporting an invalid carrying sling is pivotally joined to the upper end of the mast. A lift cylinder, joining the lower portion of the mast with the boom, is provided for raising and lowering the boom. A hand-held controller permits the invalid individual or attendant to extend, retract, raise, and lower the boom with the touch of a button. The mast may be similarly rotated. In operation, then, the sling carried by the boom may be readily moved to properly position an invalid seated therein in even the most confined of locations.

The present invention provides an invalid or handicapped individual with the ability to be more self-sufficient and to enjoy more privacy in his daily life. He can rely less on attendants or family members and more on himself. Those more severely handicapped, who cannot operate the apparatus, can still enjoy the security and peace of mind that a safe and sturdy lifting apparatus can bring. In fact, the instant lifting apparatus can postpone or even eliminate the need for placing an individual in a costly and often impersonal extended care facility. The present apparatus can assist in retaining an individual in the warmth and care of their own home.

Accordingly, it is a principal object of the present invention to provide an improved apparatus for lifting and transporting an invalid that ordinarily will require the attendance of no more than one other person to properly operate the apparatus. Generally, an invalid individual having minimal muscular strength can operate the apparatus alone.

It is another object of the invention to provide an invalid lift and transport apparatus that is stable in construction, firmly affixed to a supporting surface, and not subject to tipping or upsetting during normal use.

It is an additional object of the present invention to provide an invalid lift and transport apparatus with a hydraulically extensible boom, pivotally joined to an upright mast, for supporting an invalid carrying sling thereby granting a high range of mechanically assisted motion for a user.

It is a further object of the present invention to provide an invalid lift and transport apparatus having an extensible boom which may be elevated and lowered by the actuation of a hydraulic lift cylinder joined thereto, thereby allowing an invalid supported in a sling positioned upon the boom to be lowered into a tub, pool, or the like.

An additional object of the invention is to provide an invalid lift and transport apparatus which is smooth or "fluid" in its various movements so as to not cause short jerky movements or unnecessary vibrations of an invalid being moved. As the present invention is fully hydraulic in terms of its action, the precise actuation of its hydraulic components may be accomplished through the regulation of hydraulic fluid flow by the selective opening and closing of fluid control valves.

It is a further object of the present invention to provide an invalid lift and transport apparatus which is compact in size and will fold onto itself thereby requiring a minimum of floor space when adjusted for storage purposes. The present invention also includes few lateral projections or protrusions from its lifting surfaces which could cause damage to: the apparatus itself when improperly used, inattentive passersby, and the invalid user.

Still further, it is an object of the present invention to provide an invalid lift and transport apparatus which is safe to use and has counterbalance valves positioned upon the boom and lifting cylinders to prevent the uncontrolled motion of the mast assembly in the event of an interruption in hydraulic fluid flow. These devices also allow the precise flow of fluid to these cylinders to control the speed when descending and to prevent overrunning the pump.

It is a further object of the present invention to provide an invalid lift and transport apparatus utilizing low voltage direct current signals, safe for use in a wet environment, for actuating its hydraulic controls.

Yet a further object of the invention is to provide an apparatus of the class described which is of relatively low cost, is of great versatility, is suitable for use in lifting and transporting invalids and, in addition, is simple to operate.

It is an object of the invention to provide improved elements and arrangements thereof in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
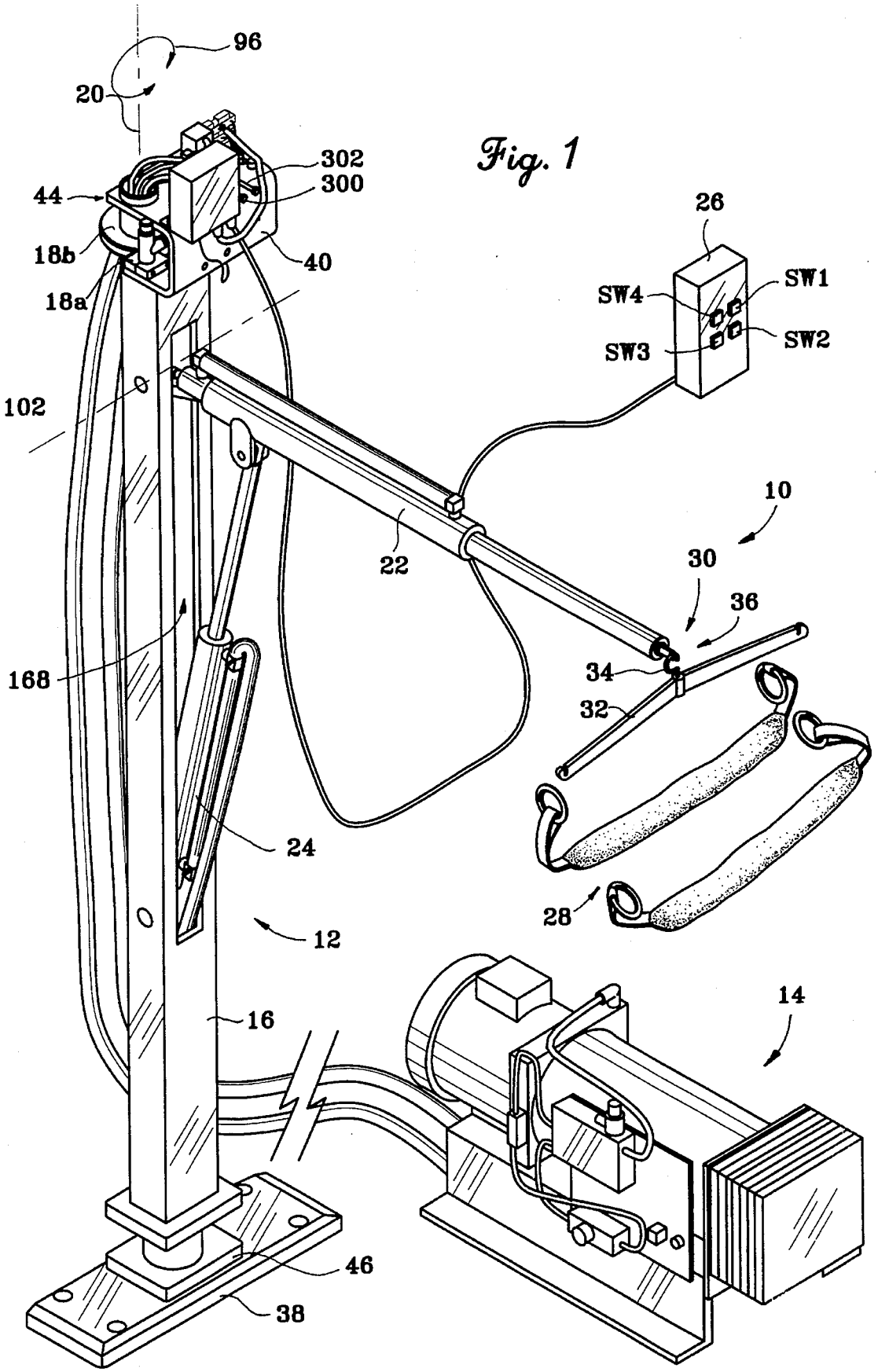
FIG. 1 is a perspective view of an invalid lift and transport apparatus in accordance with the present invention.

Referring to FIG. 1, an invalid lift and transport apparatus 10 in accordance with the present invention may be viewed. Shown by way of example only, apparatus 10 includes a mast assembly, generally indicated at 12, capable of moving an invalid individual from place to place, and a remote hydraulic pump shown at 14 for powering the hydraulic components of assembly 12. High strength metallic components enable apparatus 10 to lift five hundred pounds effortlessly and silently.

Mast assembly 12 is comprised of a number of elements which, when assembled, are capable of performing useful lifting tasks. The principal constituent elements of mast assembly 12, then, include: upright mast 16 constructed of a length of square metallic tubing, rack 18*a* and pinion 18*b* joined to the top of mast 16 for causing such to rotate about a substantially vertical axis 20, an extensible boom 22 pivotally joined to mast 16, a lifting cylinder 24 for raising and lowering boom 22, and a hand-held controller 26 for actuating the hydraulic components of apparatus 10. A sling assembly 28 for receiving the invalid individual is attached to the distal end 30 of boom 22 by means of a yoke or crossbar 32 having a hook 34 which links with a small hole or perforation 36 in boom 22.

Mast assembly 12 pivots between lower mounting bracket 38 and upper mounting bracket 40. Brackets 38 and 40 are adapted, respectively, for mounting in a spaced apart relationship upon adjacent floor and wall surfaces thereby providing rigid support to mast assembly 12. In the illustrated embodiment, brackets 38 and 40 may be joined to floor and wall structures by means of threaded fasteners such as screws and the like (not shown). As brackets 38 and 40 possess a relatively small "footprint" in that they each have a lateral extent of approximately one square foot, apparatus 10 may be mounted practically anywhere within a room without disrupting normal foot traffic patterns and easily fits within room corners.

Figure 3:
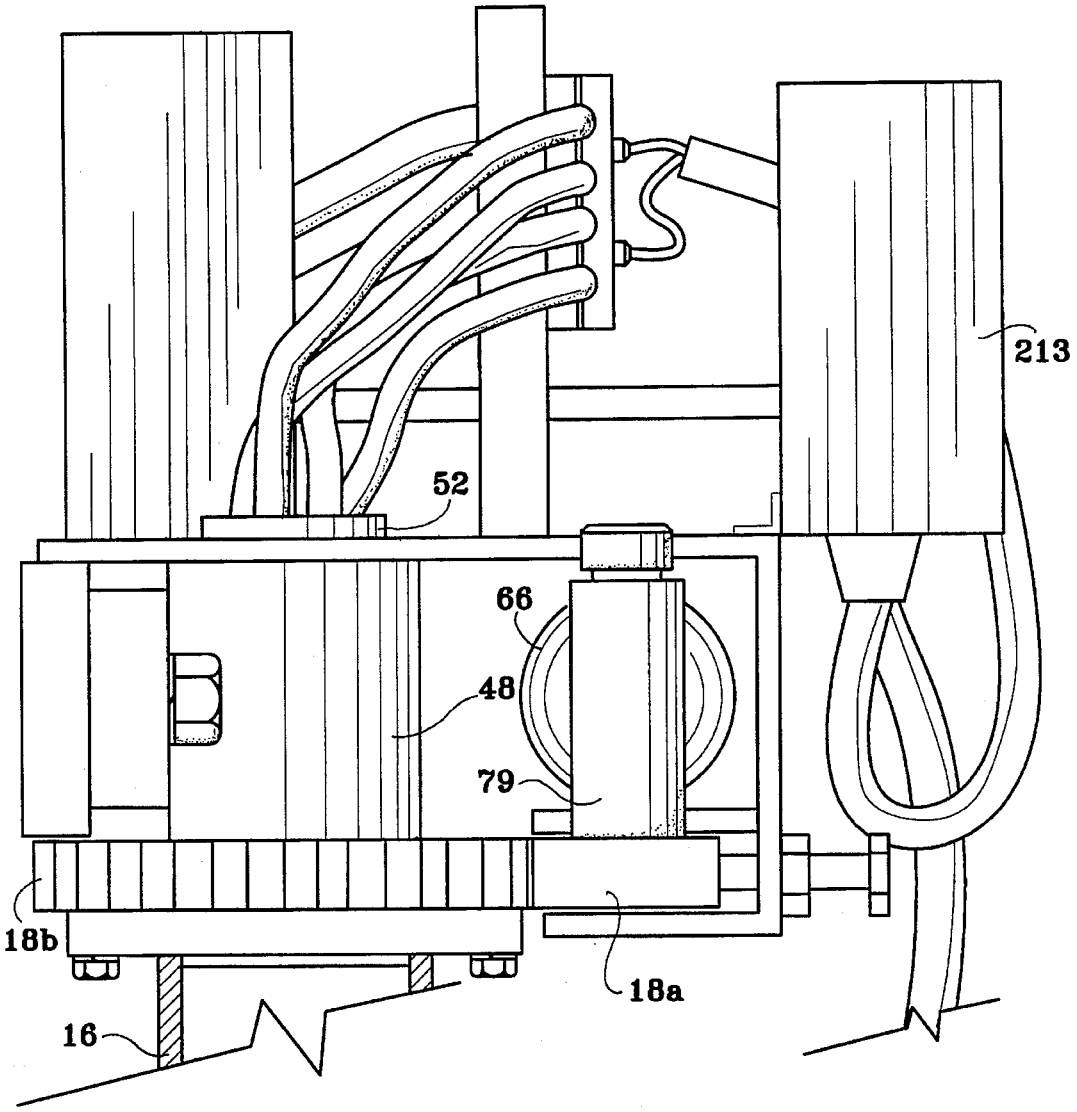
FIG. 3 is a side elevational view of the upper mounting bracket and swing cylinder assembly of the present invention.
Figure 4:
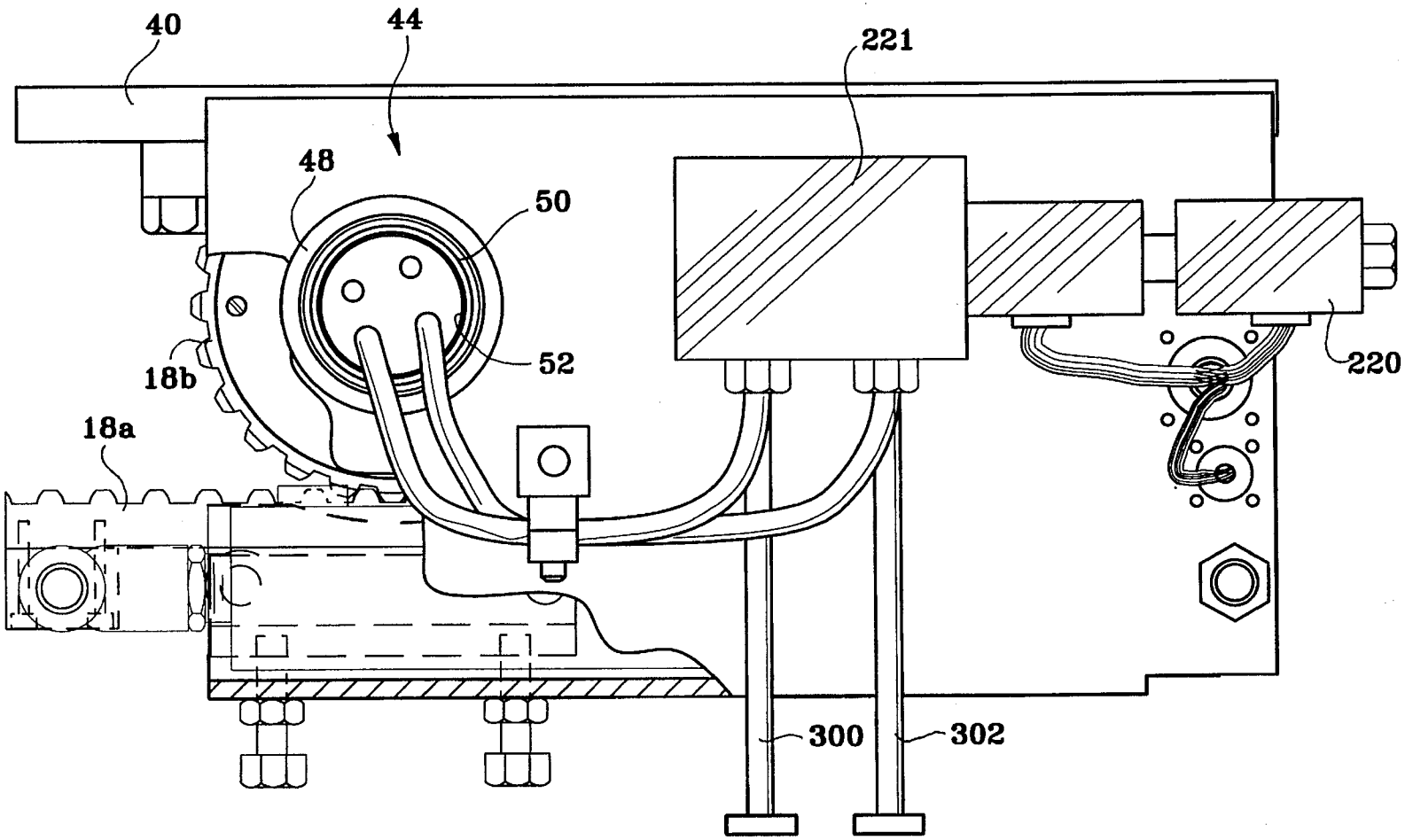
FIG. 4 is a top plan view of the upper mounting bracket and swing cylinder assembly, portions broken away to reveal details thereof.

Mast 16 is rotationally supported between mounting brackets 38 and 40 by suitable bearings. A pillow block 44, seen most clearly in FIGS. 3 and 4, joined to mounting bracket 40 was found to be the optimum bearing at the apex of mast 16 while a flange bearing 46 was found to be suitable at the base thereof. Pillow block 44, comprising a cylindrical outer sleeve 48 having a cylindrical brass liner 50 pressed therein, encloses and supports a hollow shaft 52 securely joined to the top of mast 16. When mast 16 is caused to turn about axis 20, shaft 52 rotates with minimal frictional resistance within liner 50, the long axis of shaft 52 coinciding with axis 20. A suitable flange bearing 46, on the other hand, is Model No. F3-U216N manufactured by Fafnir, Inc. of Atlanta, Ga. which is readily available as an off-the-shelf item. Flange bearing 46 is firmly affixed to lower mounting bracket 38 by means of bolts (not shown) passing through the housing thereof. Bearing 46, whose internal arrangement is not shown in the FIGS., includes a ring-shaped track containing freely revolving hard metal balls against which a portion of shaft assembly 48 joined to the base of mast 16 turns. Furthermore, bearing 46 includes an internal self-aligning feature permitting the ring-shaped track to be positioned in any orientation. Such a feature permits the non-binding rotation of mast 16 even if axis 20 deviates from vertical and lower mounting bracket 38 is not positioned directly beneath its corresponding bracket 40. By utilizing pillow block 44 and flange bearing 46, mast 16 is firmly supported in an upright orientation yet allowed to turn about a generally vertical axis 20.

Figure 2:
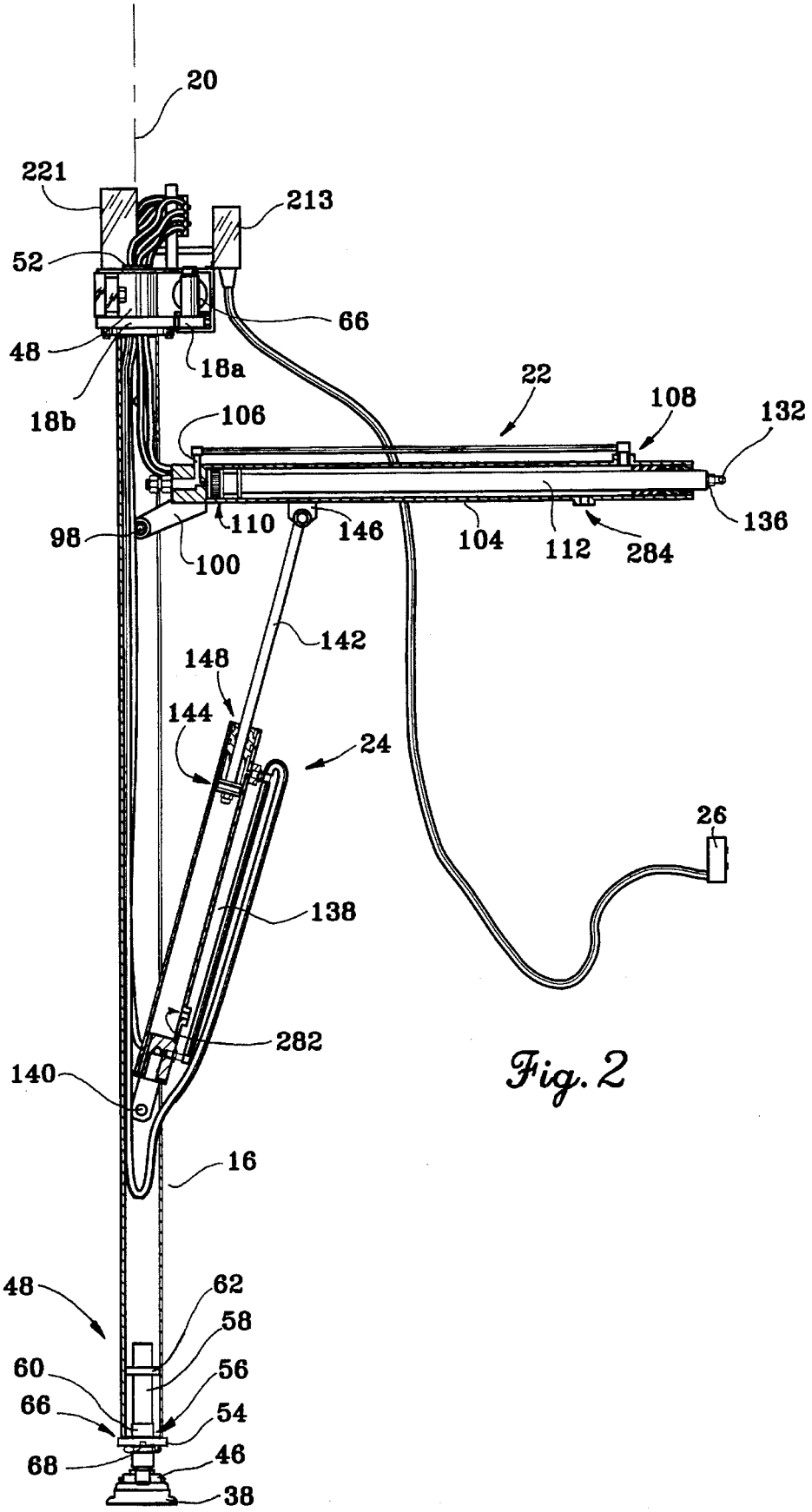
FIG. 2 is a side elevation of the apparatus of FIG. 1 partially cut away to illustrate the various means for moving the mast assembly.

As may be seen most clearly in FIG. 2, shaft assembly 48 is secured to the bottom of mast 16. In addition to providing a means for quickly erecting apparatus 10 in a fixed location, assembly 48 provides means for readily adjusting the length of mast 16 to compensate for minor differences in the relative positioning of various sets of mounting brackets 38 and 40 should the rapid movement of mast assembly 12 from one location to another be desired. Shaft assembly 48 includes a front plate 54 having a threaded central bore 56 welded to, and partially capping, the bottom of mast 16, and a shaft 58 having a threaded portion 60 approximately four inches (ten centimeters) in length and adapted for rotational engagement with bore 56. Flats (not shown) milled into the lower portion of threads 60 permit the easy rotation of shaft 58 by engagement with a wrench or similar tool and the application of a torque thereto. A back plate 62 having both a friction fit upon shaft 58 and a close sliding engagement with the interior of mast 16 retains shaft 58 in a vertical orientation under expected loads applied to apparatus 10. Once the length of shaft assembly 48 has been properly established, a jam nut 64 may be rotated upon threads 60 into engagement with front plate 54 thereby fixing the length of mast assembly 12 and preventing the further rotation of shaft 58. A washer 66, constructed of a flexible, metallic material and positioned between front plate 54 and jam nut 64, relieves friction and distributes pressure as these threaded elements are brought into close engagement. Further, a plurality of flexible tabs, as at 68, extending outwardly from the center of washer 66 may be bent downwardly to engage jam nut 64 and prevent the nut's inadvertant rotation.

Figure 8:
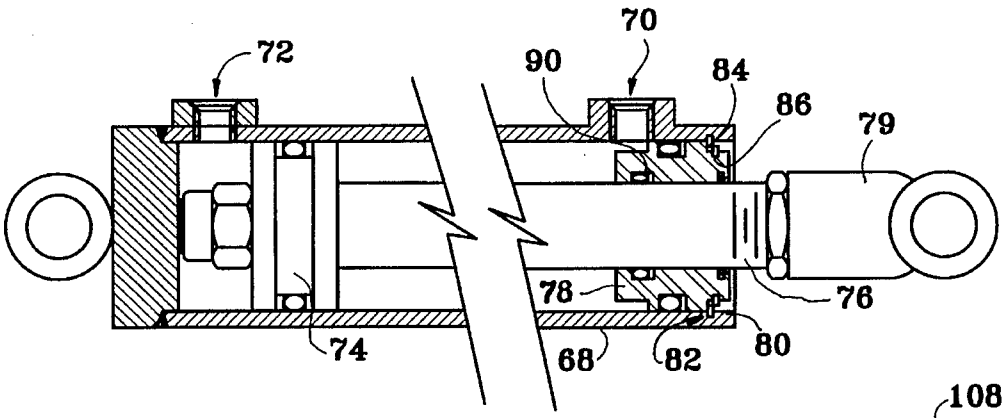
FIG. 8 is a partial, cross sectional view of swing cylinder of the present invention showing details of the gland ring assembly thereof.

Hydraulic cylinder 66 is attached to upper mounting bracket 40 and is drivingly connected to rack 18*a* and pinion 18*b* for the rotation of mast 16 based upon signals received from the hand-held controller 26. Cylinder 66 is powered by pressurized hydraulic fluid selectively delivered from remote hydraulic pump 14 in the manner described in detail below. As may be seen in FIG. 8 cylinder 66 includes an outer barrel 68 having fluid ports 70, 72 at each of its ends. Disposed within barrel 68, and between fluid ports 70, 72, is a piston 74 adapted for slidable engagement with the inner wall of barrel 68. Extending from piston 74 is a shaft 76 having a T-shaped connector 79 disposed upon the exterior of barrel 68 for engagement with rack 18*a*. Gland ring 78, machined from aluminum stock and engaging both the inner wall of barrel 68 and shaft 76, provides a fluid-tight passage for shaft 76 from the barrel 68. The gland ring 78 is prevented from exiting barrel 68 when such is pressurized by a circular retaining clip 80 having a spring-like resiliency and inserted within a circumferential groove 82 formed about the interior wall of barrel 68. A second circular retaining clip 84, positioned adjacent the first, seats within a groove 86 machined within gland ring 78. As clip 84 is located upon the "outer" side of clip 80, such prevents the gland ring 78 from moving toward the interior of barrel 68 when fluid pressure therein is reduced by catching upon clip 80. O-ring seals 88 and 90 contain pressurized hydraulic fluid within barrel 68.

When actuated by hand-held controller 26, piston 74 and its affixed shaft 76 may be caused to move laterally within barrel 68 by the introduction of pressurized hydraulic fluid into barrel 68 through either of fluid ports 70 or 72. When shaft 76 is moved, T-shaped connector 78 imparts a linear motion to rack 18*a*. As rack 18*a* and pinion 18*b* have mated teeth 92 and 94, respectively, upon their outer surfaces, the linear motion of rack 18*a* is converted to rotary motion of pinion 18*b* and connected mast 16. In this fashion, mast assembly 12 and its extensible boom 22 may be rotated about vertical axis 20 in either direction, i.e., either counterclockwise or clockwise (double arrow 96), based upon input received from the user at controller 26.

The entire upper assembly, including bracket 40, hydraulic cylinder 66, and the pinion gear 18*b*, may be mounted in a shroud or housing (not shown). A seal may be fitted into this housing and around mast 16 to prevent dust and other airborne debris from entering the housing thereby precluding dust and other airborne debris from doing damage to the assembly's moving components.

In FIG. 2 is shown that the upper end of mast 16, is provided an outwardly extending, cantilevered boom 22. An axle 98 passing through bracket 100, extending from boom 22, and mast 16 provides a means for pivotally securing boom 22 at a height above the floor or lower supporting surface for apparatus 10. Boom 22 pivots about a generally horizontal axis 102 which rotates in space about vertical axis 20 as mast assembly 12 is caused to rotate by the actuation of rack 18*a* and pinion 18*b*.

Figure 9:
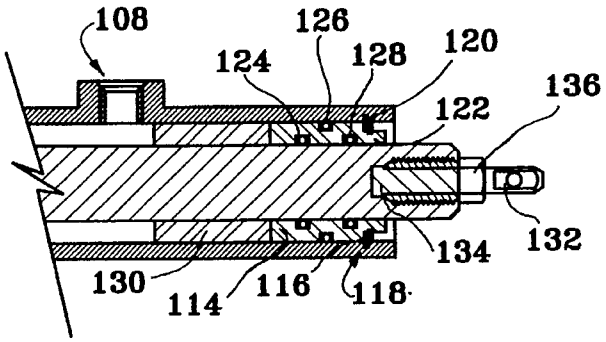
FIG. 9 is a partial, cross sectional view of the boom of the present invention showing details of the gland ring assembly thereof.

The length of boom 22 may be increased or decreased in a controlled fashion in a manner similar to that of cylinder 66 and in accordance with well known hydraulic principles. Boom 22 is powered by pressurized hydraulic fluid selectively delivered from remote hydraulic pump 14. Boom 22 includes an outer barrel 104 having fluid ports 106 and 108 at each of its ends. Disposed within barrel 104, and between fluid ports 106 and 108, is a piston 110 adapted for slidable engagement with the inner wall of barrel 104. Joined to piston 110 is a rigid shaft 112 extending substantially the length of barrel 104. Providing a fluid-tight passage for shaft 112 from the barrel 104 is gland ring 114 (best viewed in FIG. 9) machined from aluminum stock and engaging both the inner wall of barrel 104 and shaft 112. The gland ring 114 is itself prevented from exiting barrel 104 when pressurized by a circular retaining clip 116 having a spring-like resiliency and inserted within a circumferential groove 118 formed about the interior wall of barrel 104. A second circular retaining clip 120, positioned adjacent the first, seats within a groove 122 machined within gland ring 114. As clip 120 is located upon the "outer" side of clip 116, such prevents the gland ring 114 from moving toward the interior of barrel 104 when fluid pressure therein is reduced by catching upon clip 116. O-ring seals 124, 126, and 128 seated within slots of appropriate depth within gland ring 114 further assist in preventing the leakage of pressurized hydraulic fluid from barrel 104.

Positioned upon shaft 104, between piston 110 and gland ring 114, is a stop tube 130 for limiting the length to which boom 22 may extend. Stop tube 130 comprises a short length of metallic tubing having an interior diameter sufficient to permit the unimpeded passage of shaft 104 as it is extended and retracted during normal operations as well as halt the passage of the larger piston 110 when drawn together. Prior to the use of apparatus 10, stop tube 130 can be custom tailored to the needs of the user and the dimensions of the space where apparatus 10 will be employed by cutting such to the appropriate length. When properly sized, stop tube 130 will prevent the extension of shaft 112 into nearby furniture, walls, or ceilings without resort to the complex and costly adjustment means of the prior art.

A pivot pin 132 attached to the distal end of shaft 112 allows sling assembly 28 to always maintain somewhat of a vertical deposition beneath boom 22 as the shaft has been found to turn slightly during its extension and retraction. Pin 132 includes a raised shoulder 134 for engagement with a fastener 136 at one of its ends and a hole or perforation 36 for receiving hook 34 at the other. Fastener 136, having a longitudinal bore of a diameter sufficient to accept pin 132 in non-binding fashion, may be joined to shaft 112 by mated threading thereby retaining pivot pin 132 in rotatable engagement with shaft 112.

To raise and lower boom 22 in a controlled fashion, a hydraulic lifting cylinder 24 is provided. Cylinder 24 includes an outer barrel 138 pivotally mounted upon mast 16 at its lower end by means of pin 140. Cylinder 24 also includes a shaft 142 that is telescopingly received within barrel 138 and may be caused to reciprocate through the action of hydraulic pressure upon piston 144 to which shaft 142 is joined. Shaft 142 is connected at its upper end by means of a bracket 146 to boom 22, as shown, to thereby allow shaft 142 to pivotally associate with boom 22.

Figure 10:
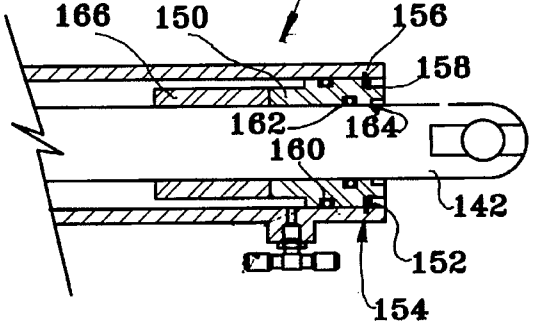
FIG. 10 is a partial, cross sectional view of the lifting cylinder of the present invention showing details of the gland ring assembly thereof.

Providing a fluid-tight passage for shaft 142 from the barrel 138 is gland ring assembly 148 substantially similar to the arrangement provided within boom 22. As may be seen in FIG. 10, assembly 148 includes a gland ring 150 machined from aluminum stock and engaging both the inner wall of barrel 138 and shaft 142. The gland ring 150 is prevented from exiting barrel 138 when such is pressurized through the admittance of hydraulic fluid by the use of a circular retaining clip 152 having a spring-like resiliency and inserted within a circumferential groove 154 formed about the interior wall of barrel 138. A second circular retaining clip 156, positioned adjacent the first, seats within a groove 158 machined within gland ring 150. As clip 156 is located "outside" or upon the "outer" side of clip 152, such prevents gland ring 150 from moving toward the interior of barrel 138 when fluid pressure therein is reduced by catching upon clip 152. O-ring seals 160, 162, and 164 seated within slots of appropriate depth within gland ring 150 further assist in preventing the leakage of pressurized hydraulic fluid from barrel 138.

Positioned upon shaft 142, between piston 144 and gland ring 148, is a stop tube 166 for limiting the length to which lifting cylinder 24 may extend. Like stop tube 130, stop tube 166 comprises a short length of metallic tubing having an interior diameter sufficient to permit the unimpeded passage of shaft 142 as it is extended and retracted during normal operations as well as halt the passage of piston 144 when drawn together. The length of stop tube 166 can be tailored to the needs of the user by cutting such to the appropriate length. When properly sized, stop tube 166 will prevent, inter alia, the elevation of boom 22 into low ceilings without resort to the complex and costly adjustment means of the prior art.

In accordance with conventional hydraulic principles, hydraulic fluid may be selectively delivered into cylinder 24 to extend shaft 142 and raise boom 22. Of course, by using an appropriately sized stop ring 166, the maximum elevation of boom 22 may be set at any height. Upon review of FIGS. 1 and 2, however, it will be apparent that with the full retraction of shaft 142 into barrel 138, the lifting cylinder 24 will come to nest within slot 168 of upright mast 16. This nesting feature provides an apparatus which is compact in size thereby requiring a minimum of floor space during periods of nonuse and storage. Further, as the present invention also includes very few lateral projections or protrusions, the likelihood of harm to the apparatus itself when improperly used, inattentive passersby, and the invalid user is minimized.

Figure 5:
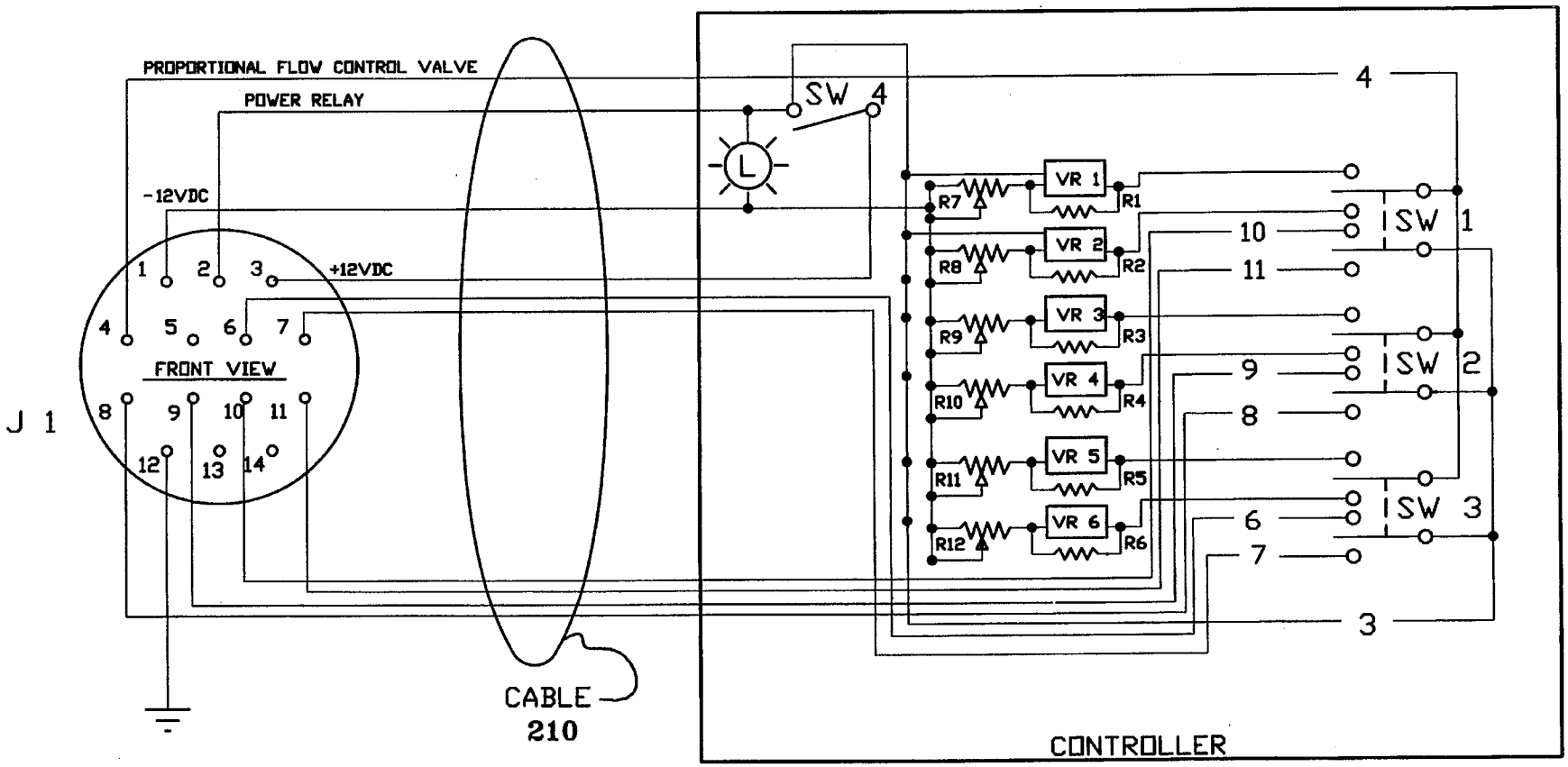
FIG. 5 is a schematic circuit diagram of the electrical circuitry of the hand-held controlled of the present invention.

FIG. 5 is a schematic diagram of the electrical circuitry for hand-held controller 26 used to direct the movements of apparatus 10. Referring to FIG. 5, hand-held controller 26 may be seen to include four switches: a main power on/off switch SW4 for actuating remote hydraulic pump 14 through the close of an electrical relay 210 (seen in FIG. 6) and delivering pressurized hydraulic fluid to the hydraulic components of mast assembly 12, an up and down switch SW1 to control lifting cylinder 24, a left and right switch SW2 to control swing cylinder 66, and an extend and retract switch SW3 to control extensible boom 22. Switches SW1, SW2, and SW3 are of the double throw type, permitting the direction of electrical current flow to solenoid valves 216, 218, and 220 (best seen in FIG. 6) as well as the resultant direction of travel of the hydraulic components 22, 24, and 66 to be reversed.

The rate of change of motion of each hydraulic component 22, 24, and 26 may be precisely regulated by controlling the electrical current flow through each of switches SW1, SW2, and SW3. Provided for this purpose are suitable voltage regulators VR1–VR6, each connected in parallel, respectively, with a 240 ohm, 0.25 watt resister R1–R6. As may be seen in FIG. 5, connected in series with the voltage regulators VR1–VR6 and parallel resisters R1–R6, are potentiometers R7–R12 for varying the resistance to electrical current flow through the respective portion of the circuit of which they are a part. A large resistance to electrical current flow established within a given potentiometer corresponds, in light of well known electromechanical principals, to a small, internal, annular opening for fluid flow within a given solenoid valve. As only a small cross sectional area is available for flow through the valve, the rate of hydraulic fluid flow delivered to the hydraulic cylinder is small thereby restricting the speed at which the hydraulic cylinder can operate. Similarly, a small electrical resistance within a given potentiometer yields a large rate of hydraulic fluid flow through the solenoid valve and a rapid movement of its corresponding hydraulic cylinder.

By way of example, the respective resistances of R7 and R8 may be set at different values thereby permitting lifting cylinder 24 to be elevated at a different rate than that at which it is lowered. A user may find it suitable to raise boom 22 at a more rapid rate from that with which it is lowered. Of course, to accomplish this, the resistance of potentiometer RS, controlling solenoid valve 220 in its upward sense, would be set at a value somewhat less than that of R7 which controls the same solenoid in its downward sense. Similarly, the left and right rotational motion of mast assembly 12 as well as the extension and retraction of boom 22 may be adjusted to suit the needs of the user.

Apparatus 10 utilizes low voltage direct current signals, safe for use in a wet environment, for actuating its hydraulic controls. If a failure were to occur at hand-held controller 26, the only direct electrical connection to power would be the 12 volt current source accessed through socket J1 as indicated in FIG. 5. This electrical isolation is particularly important when the instant lifting apparatus is used in a wet environment, such as near a pool or tub. The potential for electrical shock may be even further reduced by removing the electrical resisters R1–R12 and VR1–VR2 from the controller 26 proper and positioning such in a small housing 213 supported by upper mounting bracket 40. Moving the resisters also lightens controller 26 somewhat making such easier to grasp and manipulate.

Figure 6:
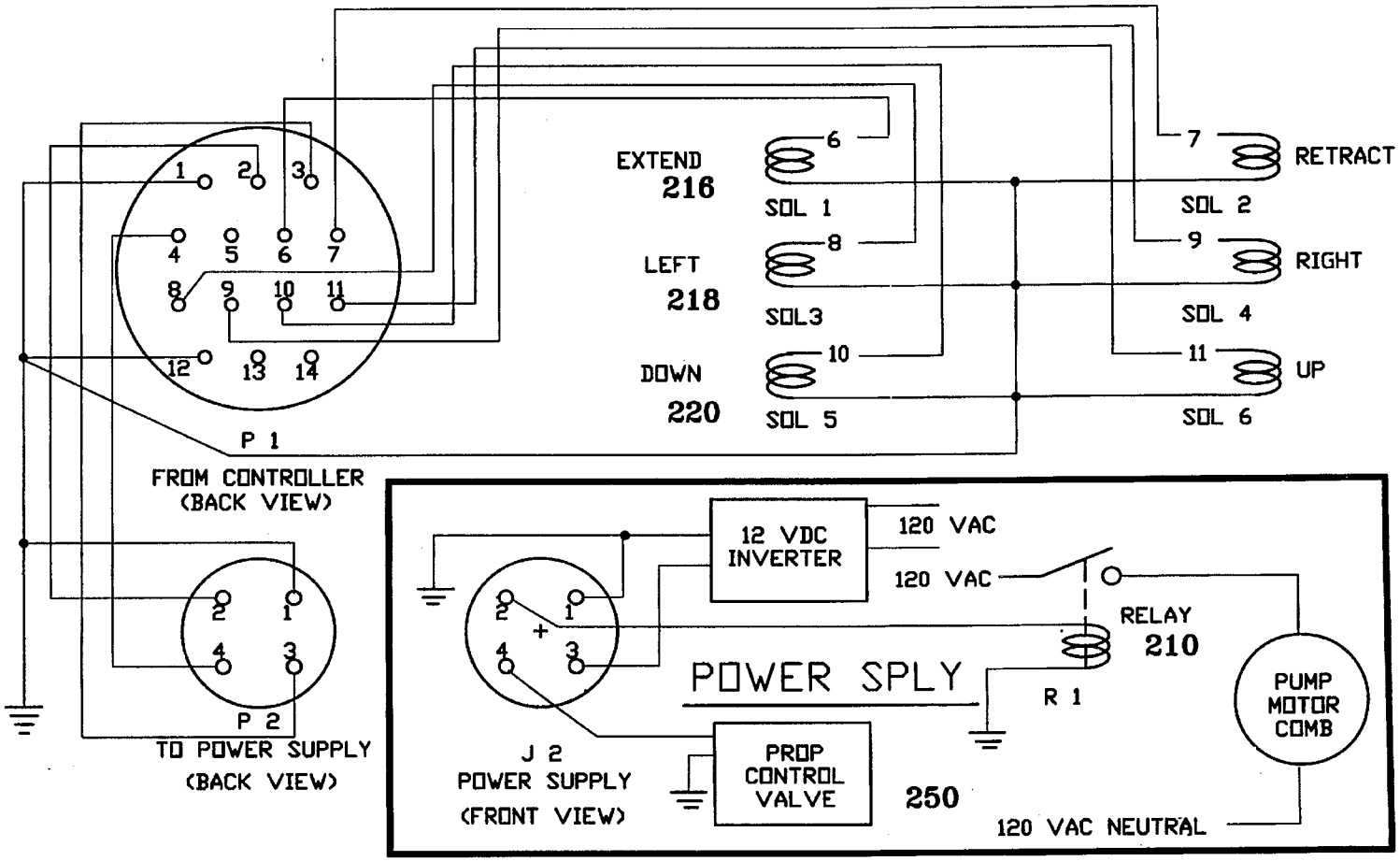
FIG. 6 is a schematic circuit diagram of the electrical circuitry of the mast assembly of the present invention.

Hand-held controller 26 is electrically connected, by means of a multi-strand cable 210 ending in a jack including socket J1 which accepts mated plug P1 of FIG. 6 at one end, to electrical solenoid valves 216, 218, and 220 disposed upon hydraulic fluid manifold 221 affixed to upper mounting bracket 40. Cable 210 is preferably an elastically coiled electrical cord for ease of storage. Controller 26 is positioned so that an individual seated in sling assembly 28 can easily grasp it and manipulate the switches. The controller is also positioned in such a manner that an attendant may also easily manipulate the switches. Included on the controller is an indicator light "L" to indicate to nearby observers that the power is on.

Figure 7:
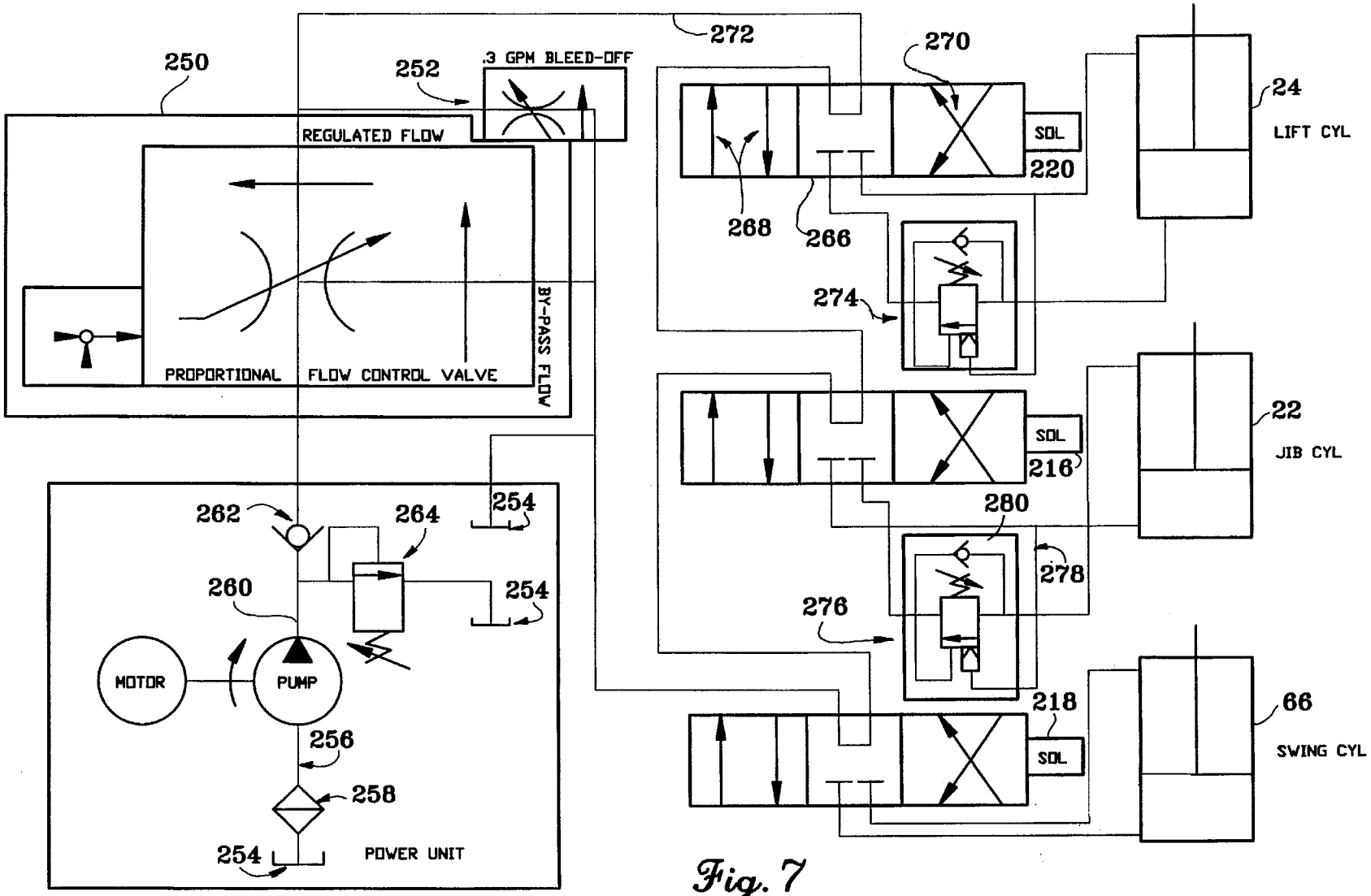
FIG. 7 is a schematic diagram of the hydraulic system of the present invention.

As may be seen schematically in FIG. 7, the hydraulic components of the instant invention are driven by hydraulic fluid delivered through various sealed conduits or flowlines from remote hydraulic pump 14. Pump 14 is electrically connected to hand-held controller 26 in a manner described above. Although other pumps may be used with equal facility, a usable pump 14, available as an off-the-shelf item, is a "motor/pump assembly with reservoir," Model No. 4F682, distributed by Grainget Supply Company of Reno, Nev. The Grainger pump includes a one horsepower electric motor capable of utilizing 120 VAC current and has a pump capacity of two gallons of hydraulic fluid per minute. The pressure rating of the Grainget pump is 750 psia. To minimize noise delivery to the user, pump 14 is preferably remotely located from mast assembly 12, i.e., outdoors, garage, closet, cellar, etc. Nevertheless, the use of hydraulic components throughout the apparatus is believed to be preferable to mechanically geared struts or other motive means as they are especially smooth and quiet in their operation.

A proportional flow control valve 250 is provided to regulate hydraulic fluid delivery from pump 14. The construction of valve 250 permits the fluid flow rate through it to be varied and subsequently fixed in accordance with a benchmark electrical potential, measuring between three and five volts, set at the time of installation. As may be seen in the electrical schematics of FIGS. 5 and 6, a fixed, electrical current potential is provided to proportional control valve 250 at a time when any of switches SW1, SW2, and SW3 are closed thereby opening valve 250 in the preset amount and delivering hydraulic fluid toward the hydraulic cylinders. Many manufacturers produce valves suitable for use in this application, however, Model No. 835-21-03, produced by the Fluid Power Systems Division of United Technologies Automotive, Inc. in Wheeling, Ill. has been found to be adequate for use as valve 250.

For proportional control valve 250 to work optimally, a relatively continuous supply of hydraulic fluid from pump 14 must be channeled through it. Coupled in series, therefore, with the proportional flow control valve 250 is a pressure compensated flow controller 252 capable of diverting 0.3 gallons of hydraulic fluid per minute away from delivery to the hydraulic cylinders 22, 24 and 66 and toward tank/reservoir 254 of pump 14. This diversion of fluid allows a net flow of 0 to 1.7 gallons per minute to be delivered to the hydraulic cylinders. Such a rate of flow has been found to be more than adequate to operate the hydraulic cylinders in a satisfactory manner and at a safe rate of speed. A suitable off-the-shelf flow controller 252 is the "Manatrol," 0.25 inch size, manufactured by Parker Fluid Power of Santa Fe Springs, Calif.

As may be seen in FIG. 7, hydraulic fluid is delivered to pump 14 from tank/reservoir 254 through a suction conduit 256 having a filter/strainer 258 to prevent the entry of debris into the pump 14 and the remainder of the flow system.

Similarly, dirt is prevented from entering the discharge conduit 260 of the pump 14 by a check valve 262 which prevents fluid backup into the pump 14 for any reason.

An adjustable pressure relief valve 264 to prevent damage to apparatus 10 in the event of a blockage within the hydraulic system is provided to divert hydraulic fluid from the pump discharge conduit 260 to the tank/reservoir 254 for storage and later reuse.

As shown in FIG. 7, solenoid valves 216, 218, and 220 are situated in a "neutral" position whereby hydraulic fluid may flow into, and out of, each valve without accomplishing useful work. In this configuration, the hydraulic fluid is delivered from one valve to the next, as they are arranged for series flow, completing an endless circuit from the pump 14 to the tank/reservoir 254 and back again. This situation occurs when none of the double throw switches SW1, SW2, and SW3 of the hand-held controller 26 has been actuated by the user to permit current flow to a solenoid valve. Therefore, apparatus 10 remains at rest.

Each solenoid valve 216, 218, and 220 possesses a slide, as at 266, having two sets of conduits for directing the flow of hydraulic fluid to and from the valve's associated hydraulic cylinder. The parallel conduits on the left side of each slide as seen in FIG. 7 at 268, permit the entry of hydraulic fluid into a given hydraulic cylinder in one directional sense whereas the crossed conduits, as at 270, on the right side of each slide permit the entry of hydraulic fluid into the hydraulic cylinder in an opposite directional sense. Each of the conduit sets 268 and 270 may be transversely shifted into communication with the hydraulic fluid supply conduit 272 by the actuation of a solenoid valve as described supra.

As solenoid valves 216, 218, and 220 are arranged in series, the actuation of lift cylinder 24 in either an up or down sense, for instance, will prevent the action of both the boom 22 and swing cylinder 66. Likewise, the actuation of boom 22 would temporarily prevent the swing cylinder 66 from being moved. Regulating the motion of apparatus 10 in this fashion permits pinpoint control of its moving parts with no unexpected forces being exerted upon the patient being carried thereby.

Means are provided for insuring that an individual suspended in sling 28 can be readily lowered and disengaged therefrom in the unlikely event of an electrical power failure or cessation of hydraulic fluid flow to the mast assembly 12. In this regard, "over center" or counterbalance valves 274 and 276 have been fitted, respectively, onto lifting cylinder 24 and boom 22. Valves 274 and 276 utilize hydrostatic pressure of the hydraulic fluid on a selected input side of the lifting cylinder or boom, respectively, to open the fluid flow channel within the valve and permit hydraulic fluid on the discharge side of the cylinder to pass therefrom. The hydrostatic pressure is supplied to valves 274 and 276 through separate pilot pressure conduits as shown schematically at 278. In addition to maintaining a constant volume of hydraulic fluid within either boom 22 and lifting cylinder 24 during both extension and retraction thereof, valves 274 and 276 include an internal, fluid check feature, as at 280, which as preferably arranged permits the entry of fluid into the "piston" side of the lifting cylinder 24 and the "shaft" side of boom 22. This same fluid check feature prevents hydraulic fluid from exiting the "piston" side of the lifting cylinder 24 and the "shaft" side of boom 22 unless a sufficient hydrostatic pressure is provided to the respective counterbalance valve by the pilot pressure conduit as described above. Therefore, as hydraulic fluid is substantially incompressible, the fluid check feature prevents the actuation of boom 22 or lifting cylinder 24 unless respective valve 274 or 276 is connected to a sufficient pilot pressure source. While boom 22 is prevented in this manner from uncontrollably extending during power loss and the like, lifting cylinder 24 is similarly prevented from retracting. Ports 282 and 284 including a hand tightened needle valve (not shown) provide a means for controllably draining hydraulic fluid from, respectively, the "piston" side of the lifting cylinder 24 and the "shaft" side of the boom 22. When port 282 is opened, hydraulic fluid is permitted to drain from lifting cylinder 24 in a manner which permits it to retract and lower an individual suspended in the sling assembly 28 to any lower elevation. On the other hand, when port 284 is selectively opened, boom 22, which is normally operated in a downward orientation, is permitted to extend or telescope outward again permitting an individual disposed within sling assembly 28 to be lowered. A hose (not shown) may be connected to either of ports 282 and 284 to permit hydraulic fluid to bleed back into tank/reservoir 254.

Similar means are provided for permitting mast assembly 12 to be rotated without inhibition of cylinder 66. Rather than place the fluid discharge ports directly upon the cylinder, however, such are mounted upon manifold 221 in such a fashion as to permit fluid to be drained to tank/reservoir 254 when knobs 300 and 302, seen in FIGS. 1 and 4, connected to separate, internal, needle valves (not shown) are rotated. Thus, in the event of unexpected power failure, an individual may be readily positioned and lowered from apparatus 10.

For many handicapped individuals, transferring is one of the most challenging tasks of the day but not with apparatus 10. By extending boom 22 in or out, up or down, or right or left, it becomes extremely versatile in transferring a person to almost any desired position. For invalid individuals who can operate hand-held controller 26 and position themselves within sling assembly 28 there is essentially no work for an attendant or family members to perform. In some instances, an attendant might help position the lift straps of sling assembly 28 but once accomplished, apparatus 10 does all the lifting; smoothly, efficiently, and quietly. But even if the person being transferred cannot position himself within sling assembly 28, or operate controller 26, apparatus 10 enables the attendant to lift the person with minimal effort or risk of injury either to the patient or the attendant.

Because apparatus 10 is so versatile, a person may be lifted and moved to almost any location within a room where the apparatus is installed. For those who are only moderately handicapped, maneuvering to their closet to pick out their clothes for the day or even over to their desk to write a note is easily accomplished. Even if these locations are relatively far from the apparatus' mounting point, the patient or handicapped person remains safe and secure because of the floor to wall mounting configuration. And because of that configuration, there is no need for extra storage space in a closet or positioning space under a patient's bed as would otherwise be required with a portable lift. When not in use, apparatus 10 may be folded upon itself with the full retraction of lifting cylinder 24.

Apparatus 10 has been developed primarily for the movement of persons who have limited mobility in their limbs making movements to a bed, wheelchair, toilet facilities, or therapeutic pool difficult. Such transfers of position normally require the assistance of another person or persons. Apparatus 10 will raise or lower, swing left or right or extend or retract horizontally to allow the patient to reach any portion of the room within the range of the unit. All of this with just the press of a button.

As an example of the operation of apparatus 10, assume that the person to be moved is initially positioned within a wheelchair and will be aided by an attendant. (Of course, the following steps can be performed by the patient alone depending upon his arm strength.) The wheelchair is first positioned beneath extensible boom 22. Sling assembly 28 is passed under the thighs of the patient and around his back. Assembly 28 is next attached to crossbar 32 suspended from boom 22. The patient would then be lifted free of the wheelchair by actuating the "up" switch SW2 on hand-held controller 26. Once free of the chair, the direction of travel of the patient can be modified by actuation of any of the other switches on controller 26, thereby transferring the patient to a bed, toilet, bath, pool, etc. By proper actuation of the controller, the patient can be properly positioned anywhere in three dimensions within the range of motion of boom 22.

It is to be understood that the present invention is not limited to the sole embodiment described above, but encompasses any and all embodiments within the scope of the following claims.

We claim:

1. An invalid lift and transport apparatus, comprising:

a lower mounting bracket adapted for mounting upon a first supporting surface;

an upper mounting bracket positioned above said lower mounting bracket, said upper mounting bracket being adapted for mounting upon a second supporting surface;

a mast pivotally supported between said upper and lower mounting brackets, said mast being rotatable about a substantially vertical axis, said mast further including means for varying the length thereof whereby said mast can be rapidly installed between said upper and lower mounting brackets; and an extensible boom mechanically associated with said mast for conveying an invalid from one location to another, said extensible boom including, a first movable piston disposed within a first outer barrel pivotally joined to said mast to provide rotation about a substantially horizontal axis, and a first stop tube positioned adjacent said first movable piston and within said first outer barrel for limiting extension of said extensible boom, said extensible boom being rotatable with said mast and having means for the connection of an invalid to be moved.

2. The invalid lift and transport apparatus according to claim 1 wherein said means for varying the length of said mast includes a threaded shaft secured to the bottom of said mast.

3. The invalid lift and transport apparatus according to claim 1 further including:

first drive means mechanically linked with said mast and said upper mounting bracket for selectively urging said mast to rotate about said substantially vertical axis;

second drive means mechanically linked with said extensible boom for selectively urging said extensible boom to rotate about said substantially horizontal axis;

input means associated with said invalid lift and transport apparatus for receiving rotational, elevational, and translational signals from an operator; and, control means associatively linked with said extensible boom, said first drive means, said second drive means, and said input means for selectively controlling the motion of said boom, said first drive means, and said second drive means based upon data received from said input means, said control means being adapted to receive data from said input means corresponding to rotational movement of said mast, receive data from said input means corresponding to elevational movement of said transport means, and receive data from said input means corresponding to the translational movement of said boom.

4. The invalid lift and transport apparatus according to claim 3 wherein said first drive means includes a first hydraulic cylinder for rotating said mast about said substantially vertical axis.

5. The invalid lift and transport apparatus according to claim 4 wherein said first hydraulic cylinder is drivingly connected to said mast by means of a pinion gear.

6. The invalid lift and transport apparatus according to claim 5 wherein said second drive means includes a second hydraulic cylinder mechanically linked between said mast and said boom for raising said boom upon extension of said second hydraulic cylinder or lowering said boom upon retraction of said second hydraulic cylinder.

7. The invalid lift and transport apparatus according to claim 6 further including:

a second counterbalance valve in fluid communication with said second hydraulic cylinder for preventing the flow of hydraulic fluid from said boom in the event of cessation of hydraulic fluid in said apparatus.

8. The invalid lift and transport apparatus according to claim 7 wherein said second hydraulic cylinder includes:

a second movable piston disposed within a second outer barrel pivotally joined to said mast; and, a second stop tube positioned adjacent said second piston and within said second outer barrel for limiting the movement thereof.

9. The invalid lift and transport apparatus according to claim 8 wherein said control means include:

a first valve in fluid communication with said first hydraulic cylinder for regulating the flow of hydraulic fluid to said first hydraulic cylinder;

a second valve in fluid communication with said second hydraulic cylinder for regulating the flow of hydraulic fluid to said second hydraulic cylinder; and, a third valve in fluid communication with said extensible boom for regulating the flow of hydraulic fluid to said extensible boom.

10. The invalid lift and transport apparatus according to claim 1 wherein said extensible boom includes hydraulic drive means for selectively varying the extension thereof, said hydraulic drive means including a first counterbalance valve in fluid communication with said extensible boom for preventing flow of hydraulic fluid from said boom in the event of cessation of hydraulic fluid in said apparatus.

11. An invalid lift and transport apparatus, comprising:

a lower mounting bracket adapted for mounting upon a first supporting surface;

an upper mounting bracket positioned above said lower mounting bracket, said upper mounting bracket being adapted for mounting upon a second supporting surface;

a mast pivotally secured between said upper and lower mounting brackets, said mast being rotatable about a substantially vertical axis;

an extensible boom pivotally mounted upon said mast and adapted to pivot about a substantially horizontal axis, said boom being further adapted to selectively extend or retract upon signal from a user;

a first hydraulic cylinder mechanically linked between said mast and said boom for raising said boom upon extension of said first cylinder and lowering said boom upon retraction of said first cylinder;

drive means mechanically linked to said mast for selectively rotating said mast about said vertical axis;

input means associated with said lift and transport apparatus for receiving elevational, rotational, and translational signals from a user; and, control means associatively linked with said extensible boom, said first hydraulic cylinder, said second drive means, and said input means for selectively controlling the motion of said boom, said first hydraulic cylinder, and said drive means based upon data received from said input means, said control means being adapted to receive data from said input means corresponding to rotational movement of said mast, receive data from said input means corresponding to elevational movement of said first hydraulic cylinder, and receive data from said input means corresponding to the translational movement of said said boom.

12. The invalid lift and transport apparatus according to claim 11 wherein said mast further includes means for varying the length thereof whereby said mast can be rapidly installed between said upper and lower mounting brackets.

13. The invalid lift and transport apparatus according to claim 11 wherein said drive means includes a second hydraulic cylinder connected to said mast by means of a pinion gear.

14. The invalid lift and transport apparatus according to claim 13 wherein said control means include:

a first valve in fluid communication with said first hydraulic cylinder for regulating the flow of hydraulic fluid to said first hydraulic cylinder;

a second valve in fluid communication with said second hydraulic cylinder for regulating the flow of hydraulic fluid to said second hydraulic cylinder; and, a third valve in fluid communication with said extensible boom for regulating flow of hydraulic fluid to said extensible boom.

15. The invalid lift and transport apparatus according to claim 11 wherein said extensible boom includes:

a first movable piston disposed within a first outer barrel pivotally joined to said mast; and, a first stop tube positioned adjacent said first piston for limiting the movement thereof.

16. The invalid lift and transport apparatus according to claim 15 wherein said first hydraulic cylinder includes:

a second movable piston disposed within a second outer barrel pivotally joined to said mast; and, a second stop tube positioned adjacent said second piston for limiting the movement thereof.

17. An invalid lift and transport apparatus, comprising:

a lower mounting bracket adapted for mounting upon a first supporting surface;

an upper mounting bracket positioned above said lower mounting bracket, said upper mounting bracket being adapted for mounting upon a second supporting surface;

a mast pivotally supported between said upper and lower mounting brackets, said mast being rotatable about a substantially vertical axis, said mast further including means for varying the length thereof whereby said mast can be rapidly installed between said upper and lower mounting brackets;

an extensible boom mechanically associated with said mast for conveying an invalid from one location to another, said extensible boom including, a movable piston disposed within a outer barrel pivotally joined to said mast to provide rotation about a substantially horizontal axis, and a stop tube positioned adjacent said movable piston and within said outer barrel for limiting extension of said extensible boom, said extensible boom being rotatable with said mast and having means for the connection of an invalid to be moved;

first drive means mechanically linked with said mast and said upper mounting bracket for selectively urging said mast to rotate about said substantially vertical axis, said first drive means including a first hydraulic cylinder for rotating said mast;

second drive means mechanically linked with said extensible boom for selectively urging said extensible boom to rotate about said substantially horizontal axis, said second drive means including a second hydraulic cylinder mechanically linked between said mast and said boom for raising said boom upon extension of said second hydraulic cylinder or lowering said boom upon retraction of said second hydraulic cylinder;

input means associated with said invalid lift and transport apparatus for receiving rotational, elevational, and translational signals from an operator; and control means associatively linked with said extensible boom, said first drive means, said second drive means, and said input means for selectively controlling the motion of said boom, said first drive means, and said second drive means based upon data received from said input means, said control means being adapted to receive data from said input means corresponding to rotational movement of said mast, receive data from said input means corresponding to elevational movement of said transport means, and receive data from said input means corresponding to the translational movement of said boom.

* * * * *